US010527288B2

(12) United States Patent
Stastny et al.

(10) Patent No.: US 10,527,288 B2
(45) Date of Patent: Jan. 7, 2020

(54) SMALL EXIT DUCT FOR A REVERSE FLOW COMBUSTOR WITH INTEGRATED COOLING ELEMENTS

(71) Applicant: Pratt & Whitney Canada Corp., Longueuil (CA)

(72) Inventors: Honza Stastny, Georgetown (CA); Robert Sze, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 465 days.

(21) Appl. No.: 15/185,317

(22) Filed: Jun. 17, 2016

(65) Prior Publication Data

US 2017/0363295 A1 Dec. 21, 2017

(51) Int. Cl.

| | |
|---|---|
| ***F23R 3/54*** | (2006.01) |
| ***F23R 3/00*** | (2006.01) |
| ***F23R 3/60*** | (2006.01) |

(52) U.S. Cl.

CPC ..... *F23R 3/54* (2013.01); *F23R 3/002* (2013.01); *F23R 3/60* (2013.01); *F05D 2240/35* (2013.01); *F05D 2260/201* (2013.01); *F05D 2260/202* (2013.01); *F05D 2260/2214* (2013.01); *F05D 2260/22141* (2013.01); *F23R 2900/00012* (2013.01); *F23R 2900/00017* (2013.01); *F23R 2900/00018* (2013.01); *F23R 2900/03042* (2013.01); *F23R 2900/03044* (2013.01)

(58) Field of Classification Search

CPC ..... F01D 9/023; F05D 2240/35; F23R 3/002; F23R 3/02; F23R 3/06; F23R 3/42–46; F23R 3/50–58; F23R 3/60; F23R 2900/00012; F23R 2900/00017; F23R 2900/00018; F23R 2900/00019; F23R 2900/03042; F23R 2900/03044; F23R 2900/03045

See application file for complete search history.

(56) References Cited

U.S. PATENT DOCUMENTS

| | | | | |
|---|---|---|---|---|
| 6,269,628 | B1 | 8/2001 | Gates | |
| 7,350,358 | B2 | 4/2008 | Patel et al. | |
| 8,116,767 | B2 | 5/2012 | Grivas et al. | |
| 2010/0154426 | A1* | 6/2010 | Parker | F23R 3/002 60/748 |
| 2013/0318986 | A1* | 12/2013 | Kraemer | F02C 7/22 60/772 |
| 2014/0366544 | A1 | 12/2014 | MacCaul et al. | |
| 2015/0059349 | A1* | 3/2015 | Patel | F23R 3/002 60/772 |

* cited by examiner

*Primary Examiner* — Scott J Walthour

(74) *Attorney, Agent, or Firm* — Norton Rose Fulbright Canada LLP

(57) ABSTRACT

The described reverse flow combustor of a gas turbine engine includes inner and outer combustor liners defining a combustor chamber therewithin. A large exit duct and a small exit duct are disposed at downstream ends of the outer and inner liner respectively. The small exit duct includes an annular ring removably mounted to a support element of the gas turbine engine and includes a plurality of cooling elements integrally formed with the annular ring and projecting therefrom into impingement airflow. The cooling elements increase the effective surface area of the inner surface of the annular ring, which is adapted to be cooled by the impingement airflow.

11 Claims, 3 Drawing Sheets

SMALL EXIT DUCT FOR A REVERSE FLOW COMBUSTOR WITH INTEGRATED COOLING ELEMENTS

TECHNICAL FIELD

The application relates generally to gas turbine engine combustors and, more particularly, to a reverse flow combustor of a gas turbine engine.

BACKGROUND

Reverse flow combustors for gas turbine engines typically include large and small exit ducts which are configured to reverse the flow of the hot combustion gases, between an upstream end of the combustor where the fuel nozzles are located to the downstream end of the combustor which is in fluid flow communication with the downstream turbine(s). In a reverse flow combustor, the small exit duct is often most susceptible to wear and/or lifecycle issues because its geometry and location in the combustor requires it to have a tight radius bend with more limited surface area available for air cooling and the like. Current designs of small exit ducts typically use ductile sheet metal to form the small exit duct, in order to overcome manufacturing challenges associated with the tight radius design. However, ductile materials are normally less durable than other components used in gas turbine engines, such as machined components and like.

Additionally, because most small exit ducts are either integrally formed with the liners of the reverse flow combustors or welded in place thereto, in the event that a small exit duct needs replacement it may become necessary to scrap the entire combustor or at least large portions thereof.

Improvements in reverse flow combustors are therefore sought.

SUMMARY

There is accordingly provided a reverse flow combustor of a gas turbine engine comprising: inner and outer combustor liners defining a combustor chamber therewithin; a large exit duct disposed at a downstream end of the outer liner forming a continuation of the outer liner; and a small exit duct disposed at and communicating with a downstream end of the inner liner, the small exit duct and the large exit duct cooperating to define a reverse flow exit passage therebetween that is configured to communicate with a turbine section of the gas turbine; wherein the small exit duct is removably fastened to a support element of the gas turbine engine, the small exit duct including an annular ring removably mounted to the support element and having an outer surface facing the combustion chamber and an opposite inner surface, and a plurality cooling elements integrally formed with the annular ring, the plurality of cooling elements being spaced apart and each extending away from the inner surface, the cooling elements including a plurality of projecting pins and/or ribs, the cooling elements increasing the effective surface area of the inner surface of the annular ring of the small exit duct which is adapted to be cooled by a cooling impingement airflow provided by the gas turbine engine.

There is also provided a small exit duct for a reverse flow combustor of a gas turbine engine, the small exit duct comprising an annular ring having an arcuate cross-section and defining an outer convex surface and an opposite inner concave surface, and a plurality of cooling elements integrally formed with the annular ring to form a monolithic unitary structure of the small exit duct, the plurality of cooling elements being spaced apart and extending away from the inner concave surface of the annular ring, the plurality of cooling elements including a plurality of projecting pins and/or ribs, the cooling elements increasing the effective surface area of the inner concave surface of the annular ring of the small exit duct which is adapted to be cooled by a cooling impingement airflow provided by the gas turbine engine.

There is further provided a method of forming a reverse flow combustor of a gas turbine engine, the method comprising: providing a removable small exit duct having an annular ring and a plurality of cooling elements integrally formed thereon, the plurality of cooling elements being spaced apart and each extending away from an inner surface of the annular ring, the cooling elements including a plurality of projecting pins and/or ribs; and positioning and removably mounting the small exit duct downstream of an inner liner of the reverse flow combustor on a support element of the gas turbine engine, and disposing the plurality of cooling elements in a path of a cooling impingement airflow provided by the gas turbine engine.

BRIEF DESCRIPTION OF THE DRAWINGS

Reference is now made to the accompanying figures in which.

DETAILED DESCRIPTION

Figure 1:
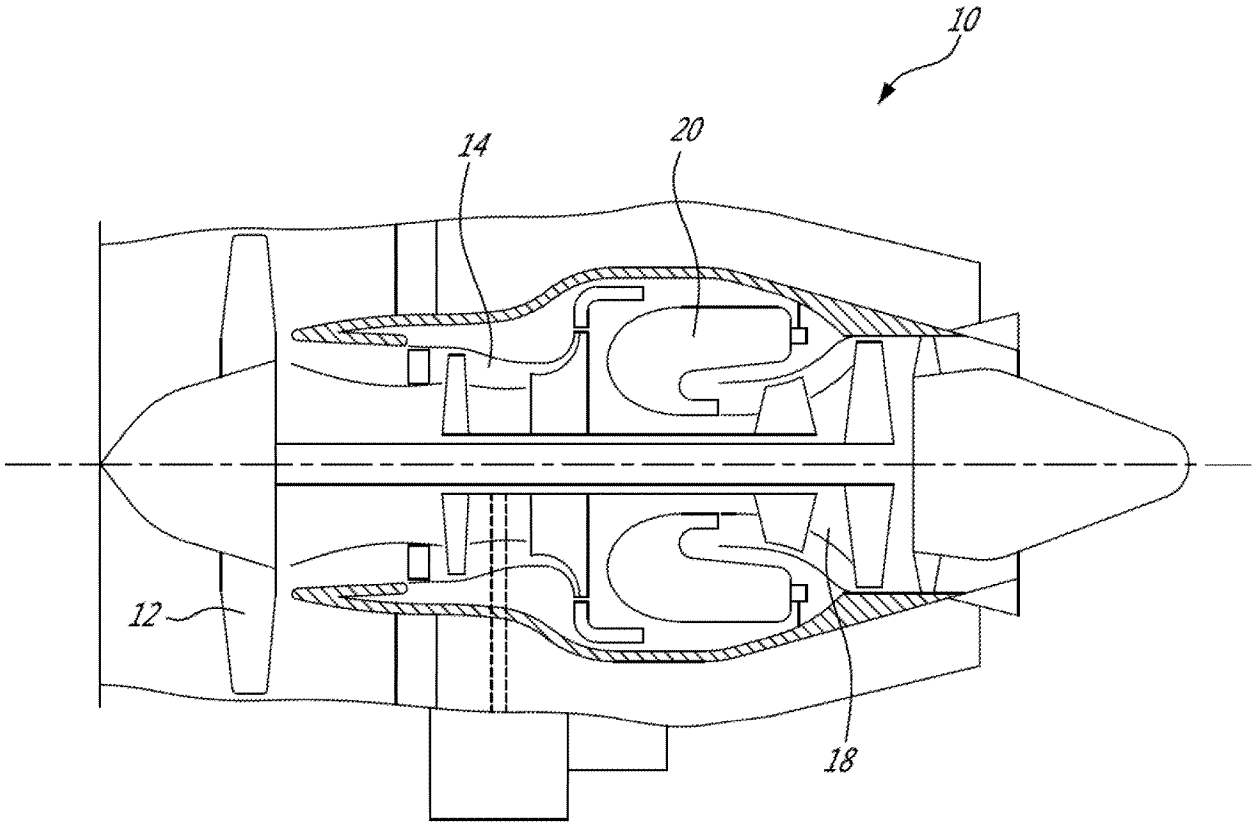
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 20 in which the compressed air is mixed with fuel and ignited for generating an annular stream of hot combustion gases, and a turbine section 18 for extracting energy from the combustion gases.

Figure 2:
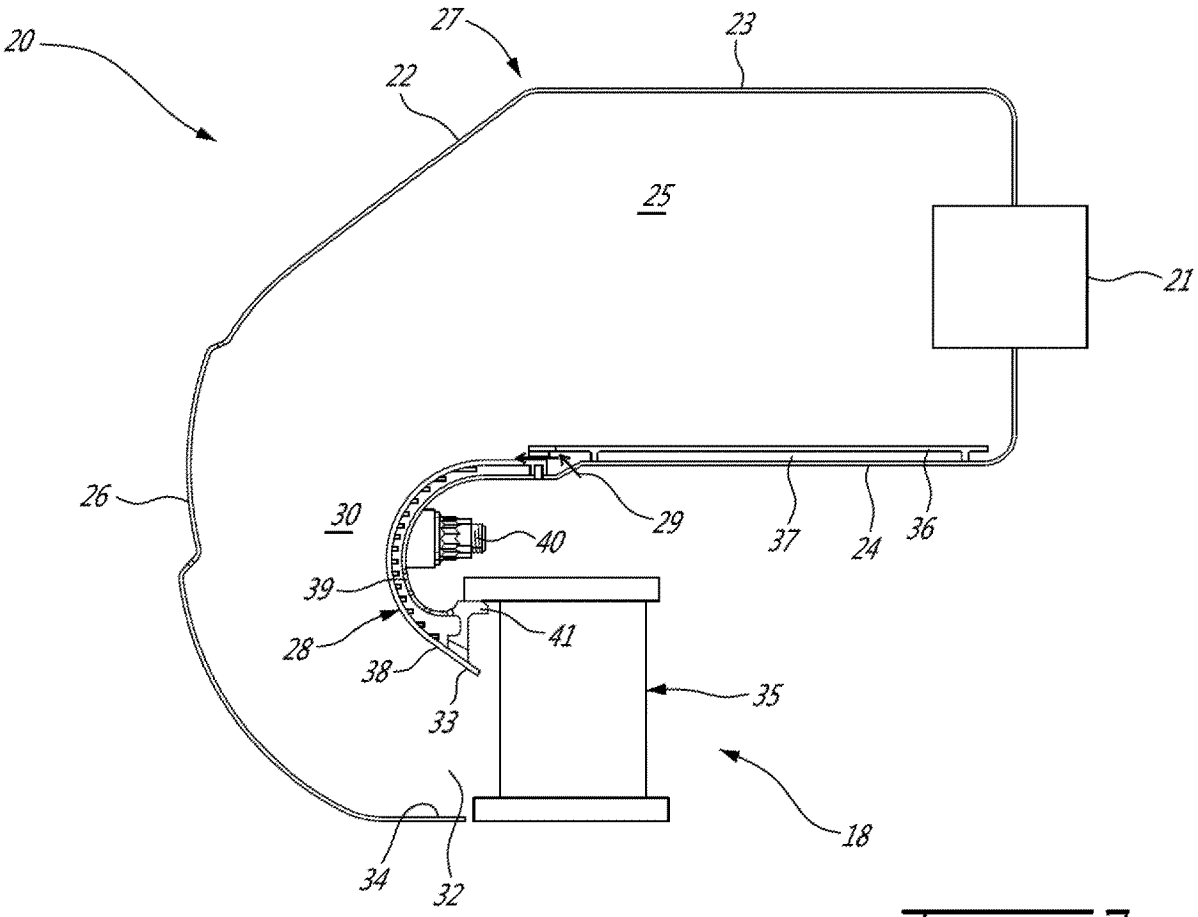
FIG. 2 is a schematic cross-sectional view of a reverse flow combustor of the gas turbine engine of FIG. 1, according to a particular embodiment of the present disclosure.

Referring to FIG. 2, a reverse flow combustor 20 of the gas turbine engine 10 according to an embodiment of the present disclosure is shown. The reverse flow combustor 20 includes a plurality of fuel nozzles 21. The fuel nozzles 21 are schematically shown as a box in FIG. 2, however, the fuel nozzles 21 can be circumferentially spaced apart to spray fuel into the reverse flow combustor 20. Other arrangements of the fuel nozzles 21 are also possible. The reverse flow combustor 20 includes a shell 22 having an outer 23 and inner 24 combustor liners. The outer and inner combustor liners 23, 24 are spaced apart and define a combustion chamber 25 between them. The inner 24 and outer 23 shells may be, in the embodiment shown, fastened together by a mechanical device or fastener(s). In the embodiment shown, the outer and inner combustor liners 23, 24 are annular and concentrically disposed thereby defining therebetween a portion of the combustion chamber 25. The outer 23 and/or inner 24 liners can have different forms and shapes. The outer and inner liners 23, 24 can be made from sheet metals and the like.

The reverse flow combustor 20 also includes a large exit duct 26 located at a downstream end 27 of the outer liner 23 and a removable small exit duct 28 located at a downstream end 29 of the inner liner 24. The large and small exit ducts 26, 28 form part of the shell 22 and cooperate together to define a reverse flow exit passage 30 between them. In the embodiment shown, the large and small exit ducts 26, 28 are spaced apart to define the reverse flow passage 30 of the combustion chamber 25. In the embodiment shown, the large exit duct 26 forms a continuation of the outer liner 23. The large exit duct 26 can be connected to the outer liner 23 by welding, for example, or may alternately be integrally formed therewith. In an alternate embodiment, the large exit duct 26 can be monolithically formed as a single sheet metal structure with the outer liner 23. The large and small exit ducts 26, 28 are bent such that the reverse flow passage 30 curves inwardly through approximately 180 degrees to discharge the stream of hot combustion gases to the turbine section 18 through an outlet 32 of the combustion chamber 25. The outlet 32 of the combustion chamber 25 is defined between a downstream end 33 of the small exit duct 28 and a downstream end 34 of the large exit duct 26. In a particular embodiment, the stream of combustion gases is discharged to high pressure turbine vanes 35, of which only one is shown.

The reverse flow combustor 20 may include one or more heat shield panels 36 disposed on the hot side of the inner liner 24 and defining an annular gap or a path 37 between the inner liner 24 and the heat shield 36 for supplying a film of cooling air to cool the shell 22 of the reverse flow combustor 20, or part of it. The starter film is mainly introduced parallel to and along the inner 24 and/or outer 23 liners. The path 37, as shown in FIG. 3, can be an annulus formed between the annular heat shield panel(s) 36 and the inner liner 24.

In the embodiment shown, the small exit duct 28 forms a continuation of the inner liner 24. The small exit duct 28 however includes a removable annular ring 38 mounted to a support element 39 of the gas turbine engine 10 via one or more fastening elements which are integrally formed with the annular ring 38. The fastening elements can include, but not limited to, clamps or the like. In the embodiment shown, the fastening elements are provided as mounting studs 40. The annular ring 38 and the mounting studs 40 may be integrally formed, such as by casting, metal injection molding (MIM) or 3D printing (i.e. rapid manufacturing). As such, the annular ring 38 and the mounting studs 40 are both simultaneously and integrally formed to create the complete small exit duct. The support element 39 can be any structure within the turbine engine 10 for mounting the annular ring 38 relative to the inner liner 24 within the combustion chamber 25. In the embodiment shown, the support element 39 forms an integral portion of the inner liner 24 and include a seat 41 abutting a portion of the high pressure turbine vane 35 in a sliding joint configuration.

Figure 3:
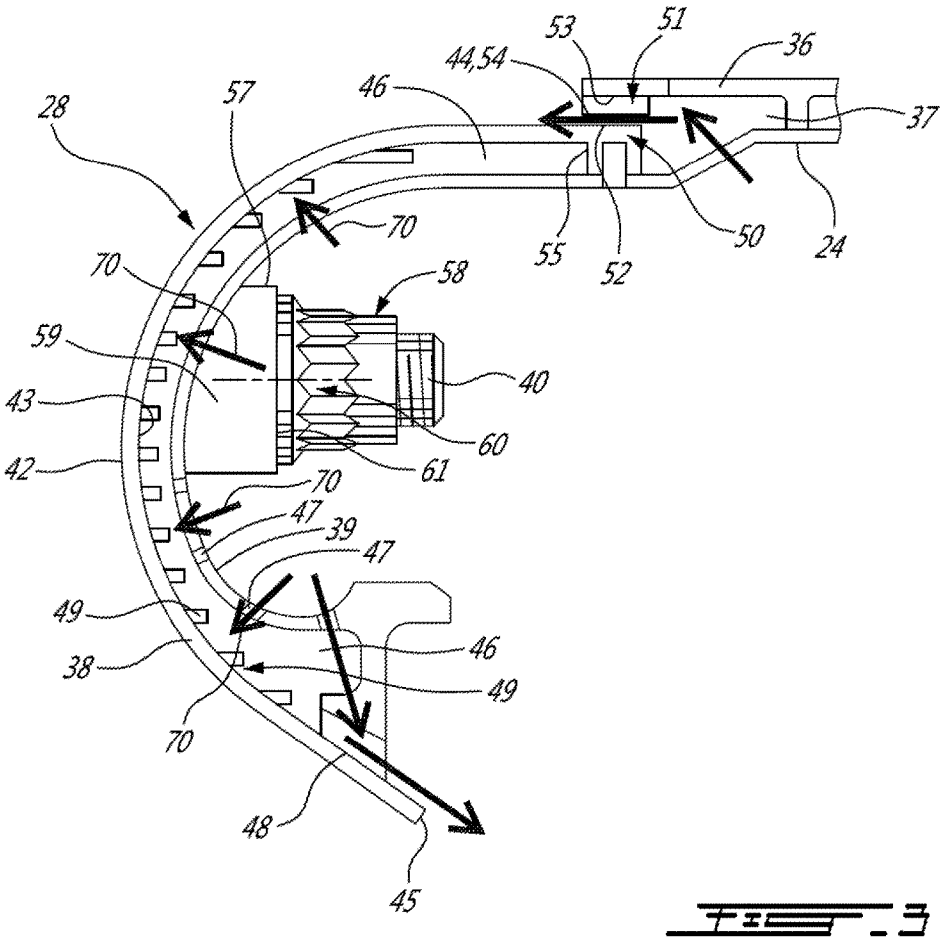
FIG. 3 is an enlarged cross-sectional view of a small exit duct of the reverse flow combustor of FIG. 2.

Referring to FIG. 3, an enlarged view of the removable small exit duct 28 is shown. The annular ring 38 of the small exit duct 28 has an arcuate cross-section defining an outer convex surface 42 and an opposite inner concave surface 43. The outer convex surface 42 faces the large exit duct 26 and is generally subjected to higher temperatures than the support element 39. The annular ring 38 extends between an outer lip 44 adjacent to the panel 36 and an opposite inner lip 45 adjacent to the outlet 32 of the combustion chamber 25. The outer lip 44 is located radially outward from the inner lip 45. In one particular embodiment, in which the small exit duct 28 is cast, the annular ring 38 is made from a high oxidation resistance castable material. The removable small exit duct 28 can also be coated in a vacuum chamber for advanced suspended plasma spray (SPS) and/or low pressure plasma spray (LPPS). These spraying techniques may improve the durability of the small exit duct 28. The outer convex surface 42 of the annular ring 38 can be coated with a ceramic coating such as the low pressure plasma spray in vacuum, suspended plasma spray (SPS), high velocity oxy fuel (hvof), or the like. The inner concave surface 43 can be coated with an aluminide coating.

The annular ring 38 is spaced apart from the support element 39 to define a cooling passage 46 between them, since the annular ring 38 is generally exposed to higher temperatures than the support element 39. The passage 46 has a proximate end adjacent to the outer lip 44 and distal end adjacent to the inner lip 45 of the annular ring 38. The support element 39 has apertures 47 defined therein to allow impingement airflow into the passage 46 through the apertures 47 for cooling the inner concave surface 43 (having additional cooling elements 49 thereon, as will be described in further detail below) of the annular ring 38. In one particular embodiment, for example, each one of the apertures 47 has a diameter between 0.02 and 0.1 inch. Impingement airflow is directed through the apertures 47 defined through the support element 39 and impinges on the inner concave surface 43 of the small exit duct 28. The impingement airflow is relatively cool and thus serves to cool the small exit duct 28 which is exposed to the combustion gases produced during combustion. Impingement jets can be used to deliver the impingement airflow. In a particular embodiment, the impingement jets are grouped to concentrate the impingement airflow on hotter areas of the small exit duct 28. The impingement airflow exits the passage 46 through an outlet 48 defined between the annular ring 38 and the support element 39 downstream of the reverse flow passage 30 towards the high pressure turbine vanes 35 for external film cooling thereof.

In the embodiment shown, the annular ring 38 includes a plurality of cooling elements 49 that are spaced apart from each other and extend away from the inner concave surface 43. In one particular embodiment, the plurality of cooling elements 49 are equally spaced apart from one another. Regardless, the cooling elements 49 are integrally formed with the annular ring 38, such as by casting, metal injection molding (MMI) or 3D printing (e.g. rapid manufacturing) for example, to form a single unitary (i.e. monolithic) piece. Advantageously, the cooling elements 49 may improve the cooling of the small exit duct 28. In one particular embodiment, these cooling elements 49 comprise a plurality of cooling pins and/or ribs, or the like, which are spaced apart from each other (such that the complete surface area of each of the individual cooling elements 49 is fully exposed to the surrounding air) and that project away from the inner surface 43 of the annular ring 38. These cooling elements 49 are thus integrally formed with the annular ring and extend away from the inner surface 43 thereof, and thereby increase (i.e. relative to a corresponding shaped and sized small exit duct annular ring 38 that is devoid of any cooling elements thereon) the effective surface area of the inner surface 43. This inner surface 43 having the cooling elements 49 therein is adapted to be cooled by a plurality of cooling impingement airflows 70, flowing through the impingement cooling holes 47 in the support element 39 as described above.

The height of the cooling elements 49 can vary depending on the application and/or operating conditions of the gas turbine engine 10, and the manufacturability of the cooling element 49. In general, these cooling elements 49 do not have to be full channel height and therefore to facilitate the extraction of the casting dyes, it is desirable to have reduced height pins or ribs.

The reverse flow combustor 20 includes a sealing ring 50 mounted to the inner liner 24, between the path 37 of the starter film and the passage 46 of the impingement airflow, to seal the proximate end of the passage 46 and to define an outlet 51 of the path 37 between an outer surface 52 of the sealing ring 50 and an inner surface 53 of the panel 36. The sealing ring 50 is, in one particular embodiment, a forged ring welded to the inner liner 24 by electron beam welding, for example. The outer lip 44 of the cast annular ring 38 has a surface 54 sealingly abutted to a surface 55 of the sealing ring 50 to form a single sealing interface between the cast annular ring 38 and the sealing ring 50. The surface 54 of the outer lip 44 can be ground to a tight tolerance together with the surface 55 of the sealing ring 50 to provide positive sealing under most operating conditions. In a particular embodiment, the small exit duct 28 is a single casting without radial ridges along its length so that the surface 44 is the only line of contact with the sealing ring 50 via surface 54. Advantageously, this arrangement provides positive sealing. Other arrangements including multiple contact designs may include ridges and therefore may not be suitable to provide a positive sealing because of casting tolerances associated with the ridges and profile tolerances thereof. In the embodiment shown, the outlet 51 of the path 37 includes an opening with sloping slats for controlling a flow of the starter film and directing the starter film towards the small exit duct 28. In an alternate embodiment, the opening of the path can include a slotted louver with wiggle strips.

In the embodiment shown, the cast annular ring 38 includes the mounting studs 40 which are integrally formed and cast with the cast annular ring 38 to form a unitary, monolithic, structure. The mounting studs 40 can include any elongated member to secure the cast annular ring 38 to the support element 39, such as a threaded or unthreaded rod, shaft or the like. The mounting studs 40 extend away from the inner concave surface 43 and are sized to fit into corresponding mounting features, shown as mounting openings 57 of the support element 39. The mounting features can include any other appropriate element. A shank 58 of each mounting stud 40 extends through the corresponding mounting opening 57. In the embodiment shown, the mounting opening 57 includes a sleeve 59 extending away from the support element 39 and a nut 60 inserted around a portion of the shank 58 and abutting an end surface 61 of the sleeve 59 to secure the mounting stud 40 relative to the mounting opening 57. The number of studs 40 used for mounting the cast annular ring 38 to the support element 39 can vary, and may depend on the width, length and/or material of the mounting studs 40 and/or the size of the engine and thus that of the small exit duct. In a particular embodiment, the number of mounting studs 40 is at least equal to the number of fuel nozzles 21. In an alternate embodiment, the number of the mounting studs 40 used can vary from half to equal the number of fuel nozzles 21.

Other attachment mechanism of the cast annular ring 38 to the support element 39 can be used, including, but not limited to, clamps. In an alternate embodiment, the annular ring 38 integrally includes sleeves for receiving studs or other mounting members. The studs or mounting members can be provided as part of the support element 39 or separately.

In use, because the small exit duct 28 is removably fastened in place on the combustor 20, the small exit duct 28 can be removed from the support element 39 by removing the nuts 60 and/or other securing elements, if used, and removing the mounting studs 40 from the corresponding mounting openings 57 of the support element 39. The entire small exit duct 28 can thus be removed entirely from the remainder of the combustor 20. This can be advantageous for maintenance and/or overhaul operations, without requiring the entire combustor to be disassembled and/or scraped simply in order to repair and/or replace the small exit duct. Therefore, the small exit duct 28 as described herein can be removed from the combustor 20 without causing any damage to any of the components and replaced without needing to replace the associated inner liner 24 or other components of the reverse flow combustor 20.

In a particular embodiment, the small exit duct 28 is installed on the reverse flow combustor 20 by removably attaching the small exit duct 28 to the support element 39 using the fastening elements, for example mounting studs 40 and securing them on the corresponding features, for example the mounting openings 57 of the support element 39. The installation also include abutting the outer lip 44 to the side surface 55 of the sealing ring 50 and aligning and leveling the outer convex surface 42 with the outer surface 52 of the sealing ring 50 to avoid a step in the flow path of the starter film. Advantageously, the outer convex surface 42 is positioned to fit flush with the outer surface 52 of the sealing ring 50 to prevent the starter film to deflect.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A method of assembling a reverse flow combustor of a gas turbine engine, the method comprising:

providing an annular ring and a plurality of cooling elements integrally formed on the annular ring, the plurality of cooling elements being spaced apart from each other and extending axially away from a concave inner surface of the annular ring, the plurality of cooling elements including a plurality of projecting pins and/or ribs;

positioning the annular ring spaced apart from an inner liner of the reverse flow combustor, the inner liner having impingement apertures therein which are operable, in use, to direct impingement cooling air jets through the impingement apertures in the inner liner and onto the plurality of cooling elements and the concave inner surface of the annular ring, and positioning at least one heat shield panel in the reverse flow combustor and spaced apart from the inner liner to define an annular gap between the inner liner and the at least one heat shield, the annular gap configured for providing, in use, a film of cooling air along at least a portion of an outer surface of the annular ring, and providing a sealing ring between the inner liner and the annular ring, the sealing ring defining an outlet of the annular gap.

2. The method of claim 1, comprising integrally forming the annular ring and the plurality of cooling elements by casting, metal injection molding, or 3D printing.

3. The method of claim 1, comprising abutting an end of the annular ring to the sealing ring to form a single sealing interface between the annular ring and the sealing ring.

4. The method of claim 1, comprising defining a passage between the annular ring and the inner liner.

5. A reverse flow combustor of a gas turbine engine, comprising:

a combustion chamber defined between an inner combustor liner and an outer combustor liner; and a reverse flow duct defining a reverse flow exit passage of the combustion chamber, the reverse flow duct including:

an outer duct wall disposed at a downstream end of the outer combustor liner relative to a flow through the reverse flow combustor, the outer duct wall forming a continuation of the outer combustor liner;

an inner duct wall disposed at a downstream end of the inner combustor liner relative to the flow through the reverse flow combustor, the inner duct wall forming a continuation of the inner combustor liner; and an annular ring removably fastened to the inner duct wall and forming a boundary of the reverse flow exit passage, the annular ring spaced apart from the inner duct wall to define a cooling passage therebetween for receiving impingement cooling airflow, the annular ring having an outer convex surface facing the reverse flow exit passage and an opposite inner concave surface facing the cooling passage, and a plurality of cooling elements integrally formed with the annular ring, the plurality of cooling elements being spaced apart from each other and extending axially away from the inner concave surface to project into the cooling passage, the plurality of cooling elements including a plurality of projecting pins and/or ribs, the inner duct wall having impingement cooling apertures therein to direct the cooling impingement airflow against the plurality of cooling elements and the inner concave surface during operation of the gas turbine engine; and at least one heat shield panel disposed in the combustion chamber and spaced apart from the inner combustor liner thereby defining an annular gap therebetween, the annular gap configured for providing a film of cooling air along at least a portion of the outer convex surface of the annular ring, and a sealing ring disposed between the inner combustor liner and the annular ring, the sealing ring defining an outlet of the annular gap.

6. The reverse flow combustor of claim 5, wherein the plurality of cooling elements are disposed entirely within the cooling passage.

7. The reverse flow combustor of claim 5, wherein the annular ring and the plurality of cooling elements are simultaneously and integrally formed by casting, metal injection molding or 3D printing.

8. The reverse flow combustor of claim 5, wherein the plurality of cooling elements are equally spaced apart from each other.

9. The reverse flow combustor of claim 5, wherein an end of the annular ring abuts the sealing ring and forms a single sealing interface with the sealing ring, the outer convex surface of the annular ring being aligned with an outer surface of the sealing ring.

10. The reverse flow combustor of claim 5, wherein the inner duct wall is integrally formed with the inner combustor liner.

11. The reverse flow combustor of claim 5, wherein the annular ring has a ceramic or aluminide coating on at least a portion thereof for insulation and oxidation resistance.

* * * * *